United States Patent [19]

Marcinko

[11] Patent Number: 4,944,844

[45] Date of Patent: Jul. 31, 1990

[54] POLYURETHANE EXTENDED NIP PRESS BLANKET

[75] Inventor: Joseph J. Marcinko, Shaker Heights, Ohio

[73] Assignee: Beloit Corporation, Beloit, Wis.

[21] Appl. No.: 378,117

[22] Filed: Jul. 11, 1989

[51] Int. Cl.[5] ..... D21F 3/02

[52] U.S. Cl. ..... 162/205; 162/358; 162/361

[58] Field of Search ..... 162/205, 358, 360.1, 162/361; 198/840, 846, 847

[56] References Cited

U.S. PATENT DOCUMENTS

| | | | |
|---|---|---|---|
| 3,557,941 | 1/1971 | Thomson | 198/847 |
| 3,630,340 | 12/1971 | Bouzat et al. | 198/847 |
| 4,229,253 | 10/1980 | Cronin | 162/361 |

FOREIGN PATENT DOCUMENTS

| | | | |
|---|---|---|---|
| 87/02080 | 4/1987 | PCT Int'l Appl. | 162/358 |

*Primary Examiner*—Karen M. Hastings

*Attorney, Agent, or Firm*—Dirk J. Veneman; Raymond W. Campbell; David J. Archer

[57] ABSTRACT

The present invention relates to a press blanket for pressing water from a formed web which extends through an extended nip defined by an elongate press shoe and a cooperating backing roll. The blanket includes a single layer of fiber reinforced urethane which defines an endless loop. The layer cooperates with the press shoe and extends through the extended nip for pressing the water from the formed web. The single layer has an inner and an outer surface and a first and a second edge zone. The inner surface slidably cooperates with the press shoe and is smooth. The inner surface has a diameter which is reproducible to within a predetermined tolerance range. The outer surface defines a plurality of parallel-spaced circumferential grooves for assisting the drainage of water from the formed web during passage of the web between the outer surface and the backing roll. The edge zones are devoid of grooves such that during use of the blanket, fracturing of the single layer in the vicinity of the grooves disposed adjacent to the edge zones is inhibited.

7 Claims, 1 Drawing Sheet

FIG. 1
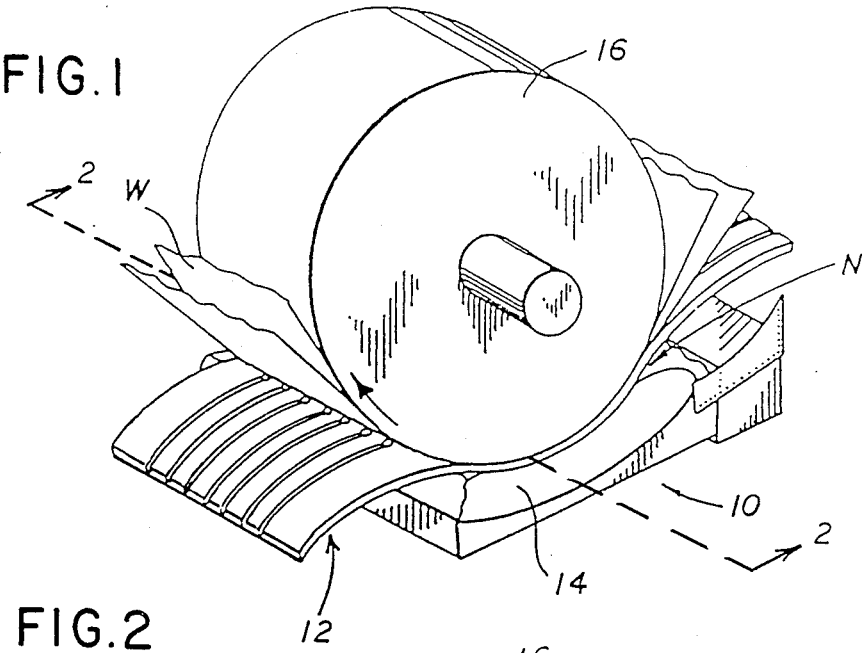
FIG. 2
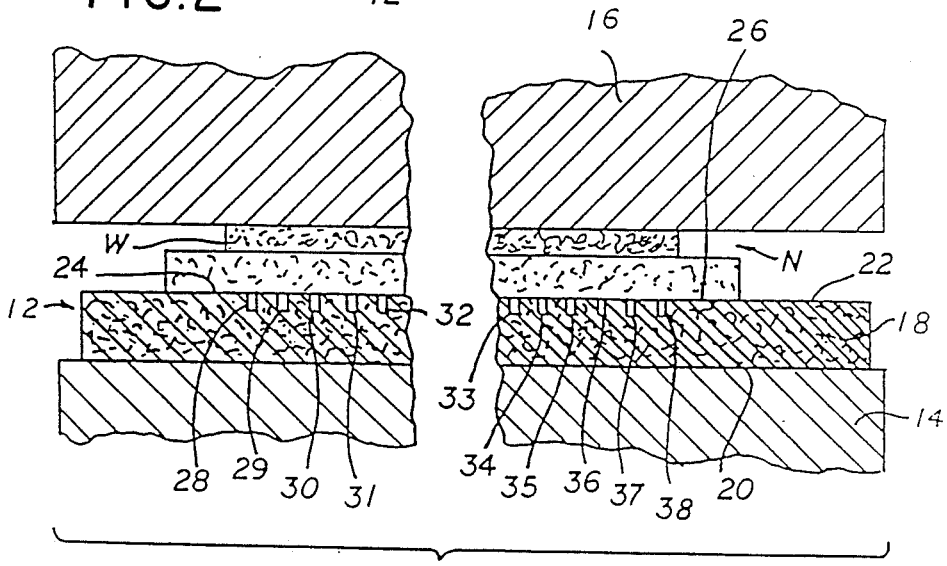
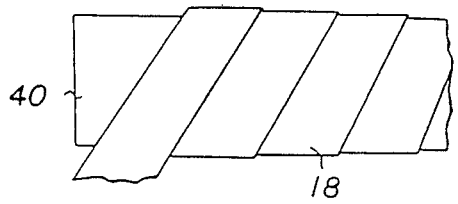
FIG. 3

POLYURETHANE EXTENDED NIP PRESS BLANKET

BACKGROUND OF THE INVENTION

FIELD OF THE INVENTION

The present invention relates to a press blanket for pressing water from a formed web. More particularly, the present invention relates to a blanket which is formed from a single layer of fiber reinforced polyurethane, the outer surface of the blanket being grooved.

INFORMATION DISCLOSURE STATEMENT

An extended nip press apparatus usually includes a movable concave press shoe which cooperates with a backing roll for defining therebetween an extended nip. A looped press blanket extends through the extended nip and slidably cooperates with the press shoe such that the web moves contiguously with the press blanket through the extended nip for removing water from the formed web.

Extended nip presses of the aforementioned type have enabled greater quantities of water to be removed from the formed web during the pressing operation when compared with the more conventional press arrangements, including a pair of counter-rotating press rolls.

Because of the increased water removing capability of the extended nip press, it has been necessary to vent the press blanket such that water may be adequately drained from the vicinity of the extended press nip.

More specifically, such press blankets have been grooved circumferentially in order to assist in the drainage of water from the formed press web.

Very high pressures are involved in the aforementioned press nips, such pressures may be in the order of 800 pounds per linear inch. Under these conditions, such grooved blankets have tended to collapse under load, thereby impairing the water draining capabilities thereof. Such collapse or "barrelling" of the blanket grooves has proved to be a problem, and in co-pending patent application No. 06/854,589, now U.S. Pat. No. 4,908,103, to Beloit Corporation, a blanket has been proposed in which the grooved surface thereof has a surface hardness of at least 94 shore "A".

Although such relatively hard urethane surface tends to reduce the barrelling phenomena, trials have indicated that because of the increased hardness of the grooved surface, there exists a tendency for the grooves to fracture and break away from the blanket.

The present invention overcomes the aforementioned problem by only grooving the blanket in a central portion thereof in the vicinity of the pressed web thereby providing lateral edge zones which are devoid of grooves.

Typically, such lateral edge zones are the areas that are particularly susceptible to groove fracture. Therefore, the absence of such grooves in these edge zones tends to inhibit such fracturing of the resultant blanket.

Therefore, it is a primary object of the present invention to provide a press blanket that overcomes the aforementioned inadequacies of the prior art proposals and to provide a press blanket that makes a considerable contribution to the art of extended nip pressing.

Another object of the present invention is the provision of a press blanket having a single layer of fiber reinforced urethane which defines an endless loop, the inner surface of the layer slidably cooperating with a press shoe and being smooth and having a diameter which is reproducible to within a predetermined tolerance range.

Another object of the present invention is the provision of a press blanket which defines a plurality of parallel-spaced circumferential grooves for assisting the drainage of water from the formed web, the edge zones of the blanket being devoid of grooves such that during use of the blanket, fracturing of the single layer in the vicinity of the grooves disposed adjacent to the edge zones is inhibited.

Another object of the present invention is the provision of a press blanket in which the single layer is fabricated from urethane, which is subsequently cured, the cured urethane having a hardness within the range 2 to 4 on the Pusey & Jones Hardness Scale.

Another object of the present invention is the provision of a press blanket wherein the single layer is fabricated from urethane reinforced with Kevlar fibers and subsequently cured.

Another object of the present invention is the provision of a press blanket which is formed by casting the single layer onto a mandrel which is subsequently removed after the single layer has cured, thereby providing a smooth, inner surface to the blanket, so that frictional resistance between the blanket and the cooperating concave surface of the press shoe is reduced.

Another object of the present invention is the provision of a press blanket in which the edge zones each have a width within the range 1 to 3 inches so that stresses tending to fracture the blanket in the vicinity of the grooves is inhibited.

Other objects and advantages of the present invention will be apparent to those skilled in the art by a consideration of the detailed description contained hereinafter taken in conjunction with the annexed drawings.

SUMMARY OF THE INVENTION

The present invention relates to an extended nip press blanket and method for pressing water from a formed web extending contiguously with the blanket through an extended nip defined between an elongate press shoe and a cooperating backing roll. The blanket includes a single layer of fiber reinforced urethane defining an endless loop. The layer cooperates with the press shoe and extends through the extended nip for pressing the water from the formed web. The single layer has an inner and an outer surface and a first and a second lateral edge zone. The inner surface of the single layer slidably cooperates with the press shoe, the inner surface being smooth and having a diameter which is reproducible to within a predetermined tolerance range. The outer surface of the single layer defines a plurality of parallel-spaced circumferential grooves for assisting the drainage of the water from the formed web during passage of the web between the outer surface and the backing roll. The edge zones are devoid of grooves such that during use of the blanket, fracturing of the single layer in the vicinity of the grooves disposed adjacent to the edge zones is inhibited.

In a more specific embodiment of the present invention, the single layer is fabricated from urethane which, when cured, has a hardness within the range of 1 to 8 on the Pusey & Jones Hardness Scale. More specifically, the range is within 2 to 4 on the Pusey & Jones Hardness Scale. The layer is fabricated from urethane which is reinforced with Kevlar fibers and subsequently cured.

The inner surface of the single layer is fabricated by casting the layer onto a mandrel, which is subsequently removed after the single layer has cured.

The edge zones each have a width within the range of 1 to 5 inches and preferably within the range of 1 to 3 inches.

The edge zones are disposed laterally relative to the formed web such that the plurality of grooves are disposed in operative relationship relative to the web for draining water from the pressed web.

The present invention also includes a method of draining water from a formed web extending through an extended nip defined between an elongate press shoe and a backing roll. The method includes the steps of moving a single layer fiber reinforced press blanket through the extended nip such that the web is disposed between the blanket and the backing roll. The method also includes the step of draining water pressed from the formed web during passage of the web through the extended nip by means of a plurality of parallel-spaced circumferential grooves. The grooves extend over an outer surface of the blanket, which faces towards the backing roll. The grooves terminate short of the first and second lateral edge zones of the blanket such that fracturing of the grooves in the vicinity of the edges zones is inhibited.

Many modifications and variations of the present invention will be apparent to those skilled in the art by consideration of the detailed description contained hereinafter taken in conjunction with the annexed drawings. Such modifications and variations, which include the use of a hydrostatic shoe, however, fall within the spirit and scope of the present invention as defined by the appended claims.

BRIEF DESCRIPTION OF THE DRAWINGS

FIG. 1 is a perspective view showing an extended nip press and a press blanket according to the present invention;

FIG. 2 is an enlarged cross-sectional view taken on the line 2—2 of FIG. 1; and FIG. 3 is a side-elevational view of a mandrel and single layered blanket formed thereon according to the present invention.

DETAILED DESCRIPTION OF THE DRAWINGS

FIG. 1 is a perspective view of an extended nip press generally designated 10. The press 10 includes a press blanket generally designated 12 for pressing water from a formed web W which extends contiguously with the blanket 12 through an extended nip N defined between an elongate press shoe 14 and a cooperating backing roll 16.

The blanket 12 includes a single layer 18 as shown in FIG. 2 of fiber reinforced urethane defining an endless loop. The layer 18 cooperates with the press shoe 14 and extends through the extended nip N for pressing water from the formed web W.

The single layer 18 has an inner and an outer surface 20 and 22 respectively and a first and second edge zone 24 and 26 respectively. The inner surface 2 of the single layer 18 slidably cooperates with the press shoe 14. The inner surface 20 is smooth and has a diameter which is reproducible to within a predetermined tolerance range.

The outer surface 22 defines a plurality of parallel-spaced circumferential grooves 28, 29, 30, 31, 32, 33, 34, 35, 36, 37 and 38 for assisting the drainage of water from the formed web W during passage of the web W between the outer surface 22 and the backing roll 16. The edge zones 24 and 26 are devoid of any grooves such that during use of the blanket 18, fracturing of the single layer 18 in the vicinity of the grooves 28 and 38 disposed adjacent to the edge zones 24 and 26 is inhibited. As can be seen most clearly in FIG. 2, the backing roll, press shoe and blanket all have substantially the same cross machine direction width, and the width of the edge zones 24 and 26 that are devoid of any grooves is substantially greater than the distance between adjacent grooves.

The single layer 18 is fabricated from cured urethane having a hardness within the range 1 to 8 on the Pusey & Jones Hardness Scale and, preferably, such hardness is within the range 2 to 4 on the Pusey & Jones Hardness Scale.

In a preferred embodiment of the present invention as shown in FIGS. 1 and 2, the single layer 18 is fabricated from urethane reinforced with Kevlar fibers and subsequently cured.

The inner surface 20 is fabricated by casting the single layer 18 onto a mandrel 40 as shown in FIG. 3. When the urethane has been cured, the blanket is then removed from the mandrel 40.

In a preferred embodiment of the present invention, the edge zones 24 and 26 each have a width within the range 1 to 5 inches and, preferably, within the range 1 to 3 inches. The edge zones 24 and 26 are disposed laterally relative to the formed web W such that the plurality of grooves 28 to 38 are disposed in operative relationship relative to the web W for draining water from the pressed web W.

The preferred method of draining water from a formed web W, which extends through an extended nip N defined between an elongate press shoe 14 and a backing roll 16, includes the steps of moving a single layer fiber reinforced press blanket 18 through the extended nip N such that the web W is disposed between the blanket 18 and the backing roll 16 and draining water pressed from the formed web W during passage of the web W through the extended nip N by means of a plurality of parallel-spaced circumferential grooves 28 to 38. The grooves 28 to 38 extend over an outer surface 22 of the blanket 18 which faces towards the backing roll 16. The grooves 28 to 38 terminate short of the first and second lateral edge zones 24 and 26 respectively of the blanket 18 such that fracturing of the grooves 28 and 38 in the vicinity of the edge zones 24 and 26 is inhibited.

The present invention provides a simple and relatively inexpensive extended nip press blanket having drainage grooves defined therein and in which fracturing of such drainage grooves in the vicinity of the edges of the blanket is inhibited.

What is claimed is:

1. In an extended nip press defined by an elongate press shoe and a cooperating backing roll, a press blanket for pressing water from a formed web extending contiguously with the blanket through an extended nip defined between the elongate press shoe and the cooperating backing roll, the press shoe, the backing roll, and the blanket all having substantially the same cross machine direction width, said blanket comprising:

a single layer of fiber reinforced urethane defining an endless loop, said layer cooperating with the press shoe and extending through the extended nip for pressing the water from the formed web;

said single layer having an inner and an outer surface and a first and a second edge zone;

said inner surface of said single layer slidably cooperating with the press shoe, said inner surface being smooth and having a diameter which is reproducible to within a predetermined tolerance range;

said outer surface defining a plurality of parallel-spaced circumferential grooves for assisting the drainage of the water from the formed web during passage of the web between said outer surface and the backing roll; and said edge zones each being devoid of said grooves for a width substantially greater than the distance between adjacent grooves such that during use of the blanket, fracturing of said single layer in the vicinity of said grooves disposed adjacent to said edge zones is inhibited.

2. A press blanket as set forth in claim 1 wherein said single layer is fabricated from cured urethane having a hardness within the range 1 to 8 on the Pusey & Jones Hardness Scale.

3. A press blanket as set forth in claim 2 wherein said single layer has a hardness within the range 2 to 4 on the Pusey & Jones Hardness Scale.

4. A press blanket as set forth in claim 1 wherein said single layer is fabricated from urethane reinforced with Kevlar fibers and subsequently cured.

5. A press blanket as set forth in claim 1 wherein said edge zones each have a width within the range 1 to 5 inches.

6. A press blanket as set forth in claim 5 wherein said edge zones each have a width within the range 1 to 3 inches.

7. A method of draining water from a formed web extending through an extended nip defined between an elongate press shoe and a backing roll, said method comprising the steps of:

moving a single layer fiber reinforced press blanket through the extended nip such that the web is disposed between the blanket and the backing roll; the press shoe, the backing roll, and the blanket all having substantially the same cross machine direction width, and draining water pressed from the formed web during passage of the web through the extended nip by means of a plurality of parallel-spaced circumferential grooves, the grooves extending over an outer surface of the blanket which faces toward the backing roll, the blanket having first and second lateral edge zones which each have a width substantially greater than the distance between adjacent grooves, the grooves terminating short of the first and second lateral edge zones of the blanket such that fracturing of the grooves in the vicinity of the edge zone is inhibited.

* * * * *

UNITED STATES PATENT AND TRADEMARK OFFICE

CERTIFICATE OF CORRECTION

PATENT NO. : 4,944,844

DATED : 07/31/90

INVENTOR(S) : Joseph J. Marcinko

It is certified that error appears in the above—identified patent and that said Letters Patent is hereby corrected as shown below:

Column 3, Line 62: Please delete "2" and insert therefor --20--.

Column 6, Line 28: Please delete "zone" and insert therefor --zones--.

Signed and Sealed this

Seventeenth Day of September, 1991

*Attest:*

HARRY F. MANBECK, JR.

*Attesting Officer*

*Commissioner of Patents and Trademarks*